United States Patent [19]

Grigaitis et al.

[11] 3,995,673

[45] Dec. 7, 1976

[54] STABILIZED AIR BUBBLE-CONTAINING EXPLOSIVE COMPOSITIONS

[75] Inventors: Benedict John Grigaitis; Harold William Holden; Terrence Charles Matts, all of Mont Saint-Hilaire; Maurice Henry Miskow; Jean Paul Richard, both of St. Bruno; Philip Faut Lit Seto, St. Lambert, all of Canada

[73] Assignee: Canadian Industries, Ltd., Montreal, Canada

[22] Filed: Feb. 6, 1975

[21] Appl. No.: 547,474

[30] Foreign Application Priority Data

Feb. 21, 1974 Canada ..... 193099

[52] U.S. Cl. ..... 149/21; 149/38; 149/47; 149/60; 149/92; 149/108.8

[51] Int. Cl.[2] ..... C06B 45/02; C06B 33/08; C06B 31/32; C06B 25/02

[58] Field of Search ..... 149/21, 38, 46, 47, 149/60, 88, 92, 108.8, 109.2

[56] References Cited

UNITED STATES PATENTS

| | | | |
|---|---|---|---|
| 3,288,661 | 11/1966 | Swisstack | 149/60 |
| 3,397,097 | 8/1968 | Atadan | 149/46 |
| 3,522,117 | 7/1970 | Atadan | 149/46 |
| 3,653,992 | 4/1972 | Fee | 149/2 |
| 3,695,947 | 10/1972 | Edwards | 149/2 |
| 3,770,522 | 11/1973 | Tomic | 149/2 |
| 3,790,415 | 2/1974 | Tomic | 149/2 |

OTHER PUBLICATIONS

Kirt, Encyclopedia of Chemical Technology, 1st Ed. (1954), vol. 13, p. 513.

Kirt, Encyclopedia of Chemical Technology, 2nd Ed. (1969) vol. 19, p. 580 and vol. 21, p. 85.

*Primary Examiner*—Samuel W. Engle
*Assistant Examiner*—Donald P. Walsh
*Attorney, Agent, or Firm*—Donald G. Ballantyne

[57] ABSTRACT

A foamed or aerated explosive composition containing a water-soluble organic nitrate sensitizer is provided which retains sensitivity for long periods in small diameter cartridges. The dissipation or migration of entrained air or gas in the composition is substantially prevented by incorporating a blend of a foaming surfactant and a stabilizing surfactant in chosen proportions.

7 Claims, No Drawings

STABILIZED AIR BUBBLE-CONTAINING EXPLOSIVE COMPOSITIONS

This invention relates to thickened and crosslinked, foamed water-bearing explosive compositions containing a water-soluble organic nitrate as the sensitizing ingredient. More specifically, this invention relates to the use of foaming surfactant and stabilizing surfactant combinations as auxiliary bubble-sensitizing aids in small diameter slurried explosive charges.

U.S. Pat. No. 3,653,992 issued Apr. 4, 1972 to H. R. Fee and E. K. Hurley discloses an aqueous slurry salt type explosive composition containing, as a sensitizer, a water-soluble organic nitrate, namely, a soluble nitratoalkanol. In pending Canadian application Ser. No. 156,070, there is disclosed a group of substantially water-free gelatinous and semi-gelatinous explosive compositions employing the same sensitizer. Both the composition of Fee and Hurley and the composition of Canadian application Ser. No. 156,070 tend to suffer from a lack of sensitivity to initiation in small diameter charges. Indeed, the aqueous slurry of Fee and Hurley is shown only to be sensitive to initiation, even in large diameter charges, when microballoons or gas bubbles are incorporated into the mixtures, it being well known in the art that the provision of voids in gelled, liquid-based mixtures increases explosive sensitivity. In the manufacture of small-diameter cartridges of water-bearing explosive compositions devoid of any sensitive self-explosive such as TNT, PETN and the like, it has been a problem of the industry to maintain adequate sensitivity during period of storage. (By small-diameter cartridges is meant a cartridge typically of 2 inches or less in diameter.) It was early noted that aeration of thickened or gelled water-bearing explosives by the addition of a foaming agent, or by the injection or the blending in of air or gas or its in situ chemical generation provided noticeable improvement in sensitivity due to the well known "hot spot" principle. It was also noted, however, that air or gas in thickened water-bearing explosives tended to be easily dissipated and hence use of these aerated compositions has generally been limited to one-site mixing locations where the explosive is detonated soon after mixing and loading into large diameter boreholes. To overcome the problem of air dissipation or leaching, the use of air-containing solid material such as resin and glass micro-ballons, particulate cork or wood pulp, vermiculite and the like has been suggested. These proposals have only met with moderate success because of the added ingredient costs involved and the problems associated with compounding mixtures containing these bulking agents.

In U.S. Pat. No. 3,288,661 issued Nov. 29. 1966 to P. L. Swisstack, it is suggested that injected air in aqueous explosive compositions can be entrained in large quantities by the use of water-soluble surfactants. It has been found, however, that even these larger volumes of entrained air are often quickly dissipated in small-diameter charges, resulting in servere loss of sensitivity. It has also been found that the use of these and other similar surfactants in compositions containing soluble organic nitrate sensitizers such as hydroxyalkyl nitrates is only of limited value because of the demonstrable incompatibility of the organic nitrate with many surfactants, giving very poor bubble formation of bubble sensitivity.

The present invention provides water-soluble organic nitrate-sensitized water-bearing explosive compositions in which entrained air is retrained in a useful form by the presence of a combination of a foaming surfactant and a stabilizing surfactant in chosen proportions. More specifically, the compositions of the invention comprise essentially a mixture of at least one inorganic oxygen-supplying salt, water, a water-soluble organic nitrate sensitizer, a thickener, a thickener cross-linker and a foaming surfactant/stabilizing surfactant combination. Exemplary of the foaming surfactant/stabilizing surfactant combinations useful in the present invention are the following:

A. Stabilizing surfactants selected from the group consiting of long chain ($C_{12}$ – $C_{22}$) aliphatic alcohols combined with foaming surfactants compatible therewith selected from the group consisting of metal alkyl sulfates, salts of sulfated alcohols and their ethoxylated derivatives such as triethanolamine lauryl sulfate, sodium lauryl sulfate, ethoxylated ammonium lauryl sulfate and the like, N-acylated aminosulfonic acids and their salts such as sodium N-methyl-N-coconut acid taurate, sodium N-methyl-N-palmitoyl taurate and the like and imidazoline derivatives such as 2-coco-1-(ethyl-$\beta$-oxipropanoic acid)-imidazoline;

B. Stabilizing surfactants selected from the group consisting of long chain ($C_{12}$ – $C_{22}$) aliphatic amines and their salts combined with foaming surfactants compatible therewith selected from the group consisting of metal alkyl sulfates, salts of ethoxylated sulfated alcohols such as sodium lauryl sulfate, ethoxylated ammonium lauryl sulfate and the like, N-acylated amino sulfonic acids and their salts such as sodium N-methyl-N-coconut acid taurate, sodium N-methyl-N-palmitoyl taurate and the like;

C. Glyceryl monoester stabilizing surfactants combined with ethoxylated ammonium lauryl sulfate foaming surfactant; and D. Ammonium stearate or stearyl alcohol stabilizing surfactants combined with ethoxylated long chain amine foaming surfactants.

The primary role of the foaming surfactant rests in the fact that it is capable of foaming the aqueous organic nitrate-containing liquor. The stabilizing surfactant cannot foam this liquor and its surface activity when used alone is usually insignificant because of its poor solubility in this liquor. It is postulated that when blended with the foaming surfactant, the stabilizing surfactant's function is to become concentrated at the surface of the film bubble and to complex with the foaming surfactant forming a stable film. The preferred combination of stabilizing surfactant and foaming surfactant comprise ethoxylated ammonium lauryl sulfate with either stearyl alcohol, stearyl, behenyl or arachidyl amines or mixtures of these. The blended surfactant mix may contain from 0.4 parts by weight of active ingredient foaming surfactant to 1 part by weight of active ingredient stabilizing surfactant up to 6.5 parts by weight of active ingredient foaming surfactant to 1 part by weight of active ingredient stabilizing surfactant. Preferably about 4 parts of the active foaming surfactant ingredient is employed for each part of active stabilizing surfactant. From about 0.1 to about 10 parts by weight of foaming surfactant/stabilizing surfactant combination is employed per 100 parts of explosive mixture. The foamed or aerated explosive compositions of the invention are characterized by a dispersion therein of small sized gaseous bubbles which resist migration, coalescence, breakdown or dissipation even after periods of storage and in small diameter cartridges.

The water-soluble organic nitrates found to be particularly suitable as sensitizers in the explosive compositions of the invention are hydroxyalkyl nitrates, such as ethylene glycol mononitrate and the like, alkanolamine nitrates such as ethanolamine nitrate and the like, and alkyl amine nitrates such as methyl amine nitrate and the like. Suitable inorganic oxygen-supplying salts for use in the explosive composition of this invention comprise ammonium nitrate, sodium nitrate, potassium nitrate, magnesium nitrate, calcium nitrate, zinc nitrate and mixtures of these.

Suitable thickener components of the explosive compositions of the invention include those compounds capable of thickening the water-soluble organic nitrate sensitizers, which compounds are known in the art. Particularly preferred are the modified guar gums such as hydroxyethyl modified guar, for example, "Gengel" E-9 (Registered Trade Mark) and hydroxypropyl modified guar, for example, "Jaguar" HP-1 (Registered Trade Mark). Any conventional cross-linker system can be used in the compositions, the preferred system being a mixture of zinc chromate and potassium pyroantimonate.

Optional additional materials may be incorporated in the explosive compositions of the invention and in particular these are materials which have a beneficial effect in further improving either sensitivity, density, stability or strength of the compositions and in the case of paper-wrapped products, rheology modifiers and extrusion aids. Typical materials found to have such effects comprise, for example, ammonium, sodium and potassium perchlorate, particulate metal fuels such as aluminium, silicon and the like, heavier metals known in the art as densifiers such as ferrosilicon, ferrophosphorus, ferrous sulphide and the like, crystal habit modifiers such as alkyl acyl sulfonic acids and the like, and absorbents or drying and bulking materials such as nitrocotton, wood pulp and the like. These optional additional materials may occupy up to 20% by weight of the composition.

Any process which will ensure the dispersion of the foaming surfactant and the stabilizing surfactant combination on a molecular level can be used in preparing the explosive compositions of the invention. Since success of the invention relies heavily upon achieving an intimate dispersion of foaming surfactant and stabilizing surfactant the perferred process embodies preheating the foaming surfactant and stabilizing surfactant together to form a paste and incorporating the paste as an ingredient in the explosive mix, which mix comprises inorganic oxidizer salts in amounts, by weight, up to 75%, water in amount up to 20%, a water-soluble organic nitrate sensitizer in amounts ranging from 5 to 25%, thickeners from 0.4 to 2.0%, cross-linkers from 0.02 to 2.0% and optional additives from 0 to 20%. Air is entrained into the explosive mix by mechanical agitation until a desired density is reached. Air may also be entrained by the addition of some of the dry ingredients at a late stage of the mixing process or by conventional chemical gassing well known in the art. The explosive may then be packaged by extrusion into small diameter plastic film or paper cartridges.

EXAMPLES 1 – 7

In order to demonstrate the effectiveness of a variety of foaming surfactant/stabilizing surfactant combinations of the present invention in maintaining a foam structure in organic nitrate sensitized mixtures, a series of compositions were prepared by adding to a base formulation various foaming surfactant/stabilizing surfactant combinations. These explosive mixtures were catridged in one-inch-diameter cartridges, stored for 24 hours at 96° F. and subjected to initiation with varying strengths of blasting caps, the ease of initiation of the catridge being an indicator of the efficiency of air entrainment. The results are shown in Table I. The base formulation explosive comprised the following:

| | | |
|---|---|---|
| Ammonium nitrate (1) | up to 56% | by weight |
| Sodium nitrate (1) | 10 – 17% | " |
| Potassium pyroantimonate | .03% | " |
| Modified guar gum | 0.6 | " |
| Zinc nitrate | 0.2 | " |
| Zinc chromate | 0.5 | " |
| Gilsonite (1) | up to 2% | " |
| Ethylene glycol mononitrate (2) | 18.0 | " |
| Water | 7.94 | " |
| Ethylene glycol | 1.6 | " |
| Silicon metal | 5.0 | " |

(1) Minor variations were made in the amounts of ammonium nitrate, sodium nitrate and gilsonite used in order to maintain an oxygen balance of the final mixture of −0.5.
(2) Technical grade containing about 90% ethylene glycol mononitrate.

TABLE I

| Examples | 1 | 2 | 3 | 4 | 5 | 6 | 7 |
|---|---|---|---|---|---|---|---|
| Surfactants * -Foaming | | | | | | | |
| Ethoxylated ammonium lauryl sulfate | 0.90 | 0.45 | 0.45 | — | — | — | — |
| Ammonium lauryl sulfate | — | — | — | 1.8 | — | — | — |
| Sodium N-methyl-N-coco-acid taurate | — | — | — | — | 2.0 | — | — |
| Sodium N-methyl-N-palmityl acid taurate | — | — | — | — | — | 1.2 | — |
| 2-coco-1(ethyl-β-oxi-propanoic acid)-imidazoline | — | — | — | — | — | — | 1.4 |
| Surfactants *-Stabilizing | | | | | | | |
| Stearyl alcohol | 0.14 | — | — | — | — | — | 0.35 |
| Mixture (50/50) of arachidyl-behenyl amines | — | 0.07 | — | 0.2 | 0.2 | 0.2 | — |
| Glycerol monostearate | — | — | 0.07 | — | — | — | — |
| Particulars: | | | | | | | |
| Density of compositions | 1.17 | 1.17 | 1.16 | 1.19 | 1.23 | 1.08 | 1.18 |
| Minimum primer in 1" diameter at 40° F. | 1[1] No. 8 F/C cap | 1 No. 7 F/C cap | 1 No. 8 F/C cap | 1[2] HS cap | 1 HS cap | 1 NO. 7 F/C cap | 1 No. 8 F/C cap |
| Relative strengths of | | | | | | | |

TABLE I-continued

| Examples | 1 | 2 | 3 | 4 | 5 | 6 | 7 |
|---|---|---|---|---|---|---|---|
| caps | 2.0 | 1.5 | 2.0 | 3.6 | 3.6 | 1.5· | 2.0 |

[1]F/C = Standard fulminate/chlorate detonator
[2]HS = High strength commercial detonator, PETN base charge 12 grains
* = Quantities shown are for commercial products containing active ingredient plus non-active carrier material

EXAMPLES 8–15

In order to demonstrate the importance of the stabilizing surfactant in preserving the efficiency of air-entrainment, a series of compositions were prepared as in Examples 1-7 both with the added foaming surfactant/stabilizing surfactant combinations and devoid of the stabilizing surfactant. The lack of cap-sensitivity in all cases where the stabilizing surfactant is omitted, is indicative of the importance of the stabilizing surfactant in complexing with the foaming surfactant to retain the entrained air in a useful form. Results are shown in Table II. The base formulation explosive comprised the following for Examples 8-15:

| | | |
|---|---|---|
| Ammonium nitrate (1) | up to 58% | by weight |
| Sodium nitrate | 10% | " |
| Potassium pyroantimonate | .03% | " |
| Modified guar gum | 0.6% | " |
| Zinc nitrate | 0.2% | " |
| Zinc chromate | 0.5% | " |
| Ethylene glycol mononitrate | 20.0% | " |
| Water | 9.4% | " |
| Ethylene glycol | 1.5% | " |
| Gilsonite (1) | up to 1.6% | " |

(1) Ammonium nitrate and gilsonite were adjusted so as to maintain an oxygen balance of −0.5.

| | | |
|---|---|---|
| Organic nitrate sensitizer | 18.0% | by weight |
| Sodium nitrate | 15.0% | " |
| 0.4 parts commercial foamer/) 1 part commercial stabilizer) | 0.53% | " |
| Modified guar gum | 0.8% | " |
| Zinc chromate | 0.2% | " |
| Potassium pyroantimonate | 0.02% | " |
| Potassium perchlorate | 2.0% | " |
| Silicon metal | 5.0% | " |
| Water | 8.0% | " |
| Ammonium nitrate (1) | up to 53% | " |
| Gilsonite (1) | up to 0.45% | " |

(1) Quantities of ammonium nitrate and gilsonite were adjusted to maintain an oxygen balance of +0.25

TABLE III

| Ex. | Water-soluble organic nitrate | Density | Minimum primer (1" dia. 40° F.) after 24 hrs. | after 12 days at 96° F. |
|---|---|---|---|---|
| 16 | Ethylene glycol mononitrate | 1.20 | 1 No. 4 F/C cap | 1 No. 4 F/C cap |
| 17 | Ethanolamine nitrate | 1.19 | 1 No. 7 F/C cap | 1 No. 8 B/C cap |
| 18 | methylamine nirate | 1.24 | 1 No. 6 F/C cap | 1 No. 7 F/C cap |

TABLE II

| Ex. | Foamer | % wt. Commercial Prod. | Stabilizer | % wt. Commercial Prod. | Formula density Mixed | Formula density Tested | Sensitivity (1" dia. at 40° F.) |
|---|---|---|---|---|---|---|---|
| 8 | Ethoxylated ammonium lauryl sulfate | 0.9 | Stearyl alcohol | 0.14 | 1.13 | 1.17 | Detonated with a No. 8 F/C cap |
| 9 | " | 0.9 | None | — | 1.10 | 1.11 | Fails with a HS cap 12 grains PETN |
| 10 | Sodium N-coconut-acid-N-methyl taurate | 2.0 | Stearyl alcohol | 0.2 | 1.11 | 1.14 | Detonated with a No. 8 F/C cap |
| 11 | " | 2.0 | None | — | 1.12 | 1.16 | Fails with a HS cap |
| 12 | Sodium N-methyl-N-palmitoyl taurate | 1.2 | Stearyl alcohol | 0.25 | 1.09 | 1.10 | Detonated with a No. 8 F/C cap |
| 13 | " | 1.2 | None | — | 1.12 | 1.18 | Fails with a HS cap |
| 14 | Triethanolamine lauryl sulfate | 0.68 | Stearyl alcohol | 0.07 | 1.05 | 1.06 | Detonated with a No. 7 F/C cap |
| 15 | " | 0.68 | None | — | 1.15 | 1.50 | Fails with 2.5 g. RDX primer |

EXAMPLES 16–18

In order to demonstrate the versatility of the foaming surfactant/stabilizing surfactant combination in maintaining a stable and useful foam structure with a variety of water-soluble organic nitrate sensitizers, a series of compositions were prepared as in previous examples, with various water-soluble organic nitrate sensitizers. In all three examples the foaming surfactant comprised ethoxylated ammonium lauryl sulfate and the stabilizing surfactant comprised a 50/50 mixture of arachidyl and behenyl amines. Results are shown in Table III.

The base formulation explosive comprised the following:

EXAMPLES 19–23

In order to show the good long-term stability of the foam structure in the explosive compositions of this invention, a series of compositions were prepared as in previous examples and using the surfactant combinations employed in Examples 16–18, then stored for 4 weeks or more at 96° F. The stability of the foam structure is reflected in retained sensitivities of the compositions as shown in Table IV, where the proportions of ingredients are in percentages by weight.

TABLE IV

| Example | 19 | 20 | 21 | 22 | 23 |
|---|---|---|---|---|---|
| Ammonium nitrate | 57.7 | 54.0 | 49.7 | 51.6 | 26.8 |
| Sodium nitrate | 10.0 | 10.0 | 16.4 | 13.2 | 30.7 |
| Ethylene glycol mononitrate | 18.0 | 18.0 | 18.0 | 18.0 | 22.5 |
| Gilsonite | 0.55 | 0.09 | — | — | — |
| Modified guar gum | 0.6 | 0.6 | 0.6 | 0.4 | 0.75 |
| Silicon | — | — | 5.0 | 5.0 | 5.0 |
| Aluminium | 3.0 | — | — | — | — |
| Potassium perchlorate | — | — | — | 2.0 | 2.0 |
| Zinc chromate | 0.5 | 0.5 | 0.5 | 0.5 | 0.63 |
| Potassium pyroantimonate | 0.03 | 0.03 | .03 | .03 | .04 |
| Hexachloroethane | — | — | 0.3 | — | — |
| Ferrosilicon | — | 5.0 | — | — | — |
| Ethylene glycol | 1.8 | 1.8 | 1.8 | 1.8 | 2.3 |
| Ethoxylated ammonium lauryl sulfate | 0.45 | 0.45 | 0.45 | 0.45 | 0.56 |
| Mixture (50/50) of arachidyl and behenyl amines | 0.07 | 0.07 | 0.07 | 0.07 | 0.09 |
| Water | 6.8 | 6.8 | 6.8 | 6.8 | 11.7 |
| Zinc nitrate | 0.4 | 0.2 | 0.2 | 0.2 | 0.2 |
| Minimum Primer (1" dia. 40° F.) | | | | | |
| after 24 hours | 1 No. 6 EB cap | 1 No. 6 EB cap | 1 No. 7 F/C cap | 1 No. 4 F/C cap | 1 No. 5 F/C cap |
| after 4 weeks or more at 96° F. storage | 1 No. 8 F/C cap | 1 No. 8 F/C cap | 1 No. 7 F/C cap | 1 No. 4 F/C cap | 1 No. 5 F/C cap |

EXAMPLES 24–28

In order to show the versatility of the foaming surfactant/stabilizing surfactant combinations in explosive compositions of various water content, a series of compositions were prepared as in the previous examples and tested for sensitivity. The compositions of Examples 26 and 27 which include rheology modifiers and extrusion aids together with the foaming surfactant/stabilizing surfactant combinations of this invention, were packaged in paper wrapped cartridges by means of conventional gelatin-screw-type extruders. The results are shown in Table V where the proportions of ingredients are in percentages by weight.

TABLE V

| Example | 24 | 25 | 26 | 27 | 28 |
|---|---|---|---|---|---|
| Water | 11.0 | 5.0 | 5.2 | 5.7 | 3.0 |
| Ammonium nitrate | 46.6 | 51.9 | 58.3 | 58.0 | 53.8 |
| Sodium nitrate | 15.0 | 15.0 | 14.0 | 14.0 | 15.0 |
| Ethylene glycol mononitrate | 17.4 | 17.3 | 13.0 | 12.5 | 17.3 |
| Gilsonite | 0.15 | 0.82 | — | — | 0.90 |
| Modified guar gum | 0.4 | 0.4 | 0.73 | 0.56 | 0.4 |
| Silicon | 5.0 | 5.0 | — | — | 5.0 |
| Aluminium | — | — | 4.0 | 3.5 | — |
| Potassium perchlorate | 2.0 | 2.0 | — | — | 2.0 |
| Nitrocotton | — | — | — | 1.8 | — |
| Pulp No. 1 | — | — | 1.0 | 1.5 | — |
| Pulp No. 2 | — | — | 1.5 | — | — |
| Zinc chromate | 0.2 | 0.2 | — | 0.03 | 0.2 |
| Potassium pyroantimonate | 0.02 | 0.02 | 0.10 | 0.10 | 0.02 |
| Ethylene glycol | 1.5 | 1.6 | 1.3 | 1.3 | 1.7 |
| Ethoxylated ammonium lauryl sulfate | 0.45 | 0.45 | 0.42 | 0.50 | 0.45 |
| Mixture (50/50) of arachidyl and behenyl amines | 0.07 | 0.07 | — | 0.10 | 0.07 |
| Stearyl alcohol | — | — | 0.08 | — | — |
| Zinc nitrate | 0.2 | 0.2 | — | — | 0.2 |
| Chalk | — | — | 0.3 | 0.3 | — |
| Auxilary thickeners | — | — | .07 | 0.14 | — |
| Borax | — | — | .04 | 0.04 | — |
| Diameter | 1" | 1" | 2" | 1.5" | 1.5" |
| Density | 1.19 | 1.13 | 1.20 | 1.21 | 1.09 |
| Minimum primer | 1 | 1 | 1 | 1 | 1 |

TABLE V-continued

| Example | 24 | 25 | 26 | 27 | 28 |
|---|---|---|---|---|---|
| at 40° F. | No. 5 F/C cap | No. 4 F/C cap | No. 8 F/C cap | No. 8 F/C cap | No. 3 F/C cap |

As will be clear from the foregoing, a gelled, water-containing explosive composition sensitized by means of a water-soluble organic nitrate can be provided having exceptional sensitivity to initiation even in small diameter charges and even after extended storage periods.

While the invention has been fully described in the foregoing, modifications in the details of the composition and manufacturing process may be made without departure from the scope of the invention.

The embodiments of the invention in which an exclusive property or privilege is claimed are defined as follows:

1. A thickened and crosslinked, foamed, water bearing explosive composition comprising essentially water, at least one inorganic oxygen-supplying salt, a water-soluble organic nitrate sensitizer, a thickener, a thickener cross-linker, entrapped sensitizing gas bubbles and at least a dual-component gas bubble stabilizer which stabilizer acts to prevent the dissipation, coalescence, migration or breakdown of said entrapped sensitizing gaseous bubbles, said dual-component stabilizer comprising a combination of at least one foaming surfactant and at least one stabilizing surfactant wherein the quantity of foaming surfactant/stabilizing surfactant combination comprises between 0.1% and 10% by weight of the total explosive composition, said dual component stabilizer being selected from the mixtures:

A. At least one stabilizing surfactant selected from the group consisting of long Chain ($C_{12} - C_{22}$) aliphatic alcohols combined with at least one foaming surfactant compatible therewith selected from the group consisting of metal alkyl sulfates, salts of sulfated alcohols and their ethoxylated derivatives such as triethanolamine lauryl sulfate, sodium lauryl sulfate, ethoxylated ammonium lauryl sulfate and the like, N-acylated aminosulfonic acids and their salts such as sodium N-methyl-N-coconut acid taurate, sodium N-methyl-N-palmitoyl taurate and the like and imidazoline derivatives such as 2-coco-1-(ethyl-$\beta$-oxipropanoic acid)-imidazoline;

B. At least one stabilizing surfactant selected from the group consisting of long chain ($C_{12} - C_{22}$) aliphatic primary amines and their salts combined with at least one foaming surfactant compatible therewith selected from the group consisting of metal alkyl sulfates, salts of ethoxylated sulfated alcohols such as sodium lauryl sulfate, ethoxylated ammonium lauryl sulfate and the like, N-acylated amino sulfonic acids and their salts such as sodium N-methyl-N-coconut acid taurate, sodium N-methyl-N-palmitoyl taurate and the like; and C. At least one glyceryl monoester stabilizing surfactant combined with ethoxylated ammonium lauryl sulfate foaming surfactant, said resulting gas bubble-stabilized explosive composition being characterized by a sensitivity to blasting cap initiation in unconfined cartridges of 2 inch or less in diameter.

2. An explosive composition as claimed in claim 1 wherein the water-soluble organic nitrate sensitizer is selected from the group consisting of hydroxyalkyl nitrates, alkanolamine nitrates and alkyl amine nitrates.

3. An explosive composition as claimed in claim 2 wherein the hydroxalkyl nitrate is ethyleneglycol mononitrate.

4. An explosive composition as claimed in claim 1 containing up to 75% by weight of inorganic oxygen-supplying salt, up to 20% by weight of water, from 5% to 25% by weight of water-soluble organic nitrate sensitizer, from 0.3% to 2% by weight of a thickener, from 0.02% to 2% by weight of a thickener crosslinker sensitizing gas bubbles and from 0.1% to 10% by weight of at least a dual-component gas bubble stabilizer comprising a mixture of at least one foaming surfactant and at least one stabilizing surfactant in the ratio of from 0.4 parts by weight active ingredient of foaming surfactant to 1 part by weight active ingredient of stabilizing surfactant to 6.5 parts by weight active ingredient of foaming surfactant to 1 part by weight of active ingredient stabilizing surfactant.

5. An explosive composition as claimed in claim 4 also containing up to 20% by weight of optional additives selective from fuel ingredients comprising aluminium and silicon, sensitizing ingredients comprising inorganic perchlorates, density control ingredients comprising ferrosilicon, ferrophosphorus and ferrous sulphide, crystal habit modifiers comprising alkyl aryl sulphonic acids, and rheology modifiers and extrusion aids comprising nitrocotton, pulp, polyoxyethylene and hydroxyethyl celluloses.

6. A process for the manufacture of a gas bubble stabilized, thickened, crosslinked and foamed water-bearing explosive composition sensitive to blasting cap initiation in unconfined cartridge diameters of 2 inch or less which comprises the steps of combining together under the influence of heat at least one stabilizing surfactant and at least one foaming surfactant in a ratio of from 0.4 parts by weight active ingredient of foaming surfactant to 1 part by weight of active ingredient of stabilizing surfactant to 6.5 parts by weight of active ingredient foaming surfactant to 1 part by weight of active ingredient stabilizing surfactant to form at least a dual-component gas bubble stabilizer of paste-like consistency and thereafter adding between about 0.1% and 10% by weight of said paste-like dual-component mixture to an explosive composition comprising essentially water, inorganic oxygen-supplying salt, water-soluble organic nitrate sensitizer, thickener, occluded gas bubbles and a thickener cross-linker.

7. An explosive composition as claimed in claim 1 wherein the thickener is selected from the group of hydroxyethyl modified guar and hydropropyl modified guar.

* * * * *